US007832375B2

(12) United States Patent
Dusa et al.

(10) Patent No.: US 7,832,375 B2
(45) Date of Patent: Nov. 16, 2010

(54) ADDRESSING FUEL PRESSURE UNCERTAINTY DURING STARTUP OF A DIRECT INJECTION ENGINE

(75) Inventors: Daniel Dusa, West Bloomfield, MI (US); Joseph Lyle Thomas, Kimball, MI (US); Gopichandra Surnilla, West Bloomfield, MI (US); Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 97 days.

(21) Appl. No.: 12/266,104

(22) Filed: Nov. 6, 2008

(65) Prior Publication Data

US 2010/0108035 A1 May 6, 2010

(51) Int. Cl.
*F02M 57/02* (2006.01)
*F02D 41/06* (2006.01)

(52) U.S. Cl. ..... 123/446; 123/179.16; 123/179.17

(58) Field of Classification Search ..... 123/179.16, 123/179.17, 446, 447, 497, 494
See application file for complete search history.

(56) References Cited

U.S. PATENT DOCUMENTS 5,425,342 A * 6/1995 Ariga et al. ..... 123/456
5,546,912 A * 8/1996 Yamada et al. ..... 123/511
5,572,964 A * 11/1996 Cogneville et al. ..... 123/179.17
5,651,347 A * 7/1997 Oi et al. ..... 123/487
5,711,275 A * 1/1998 Minagawa et al. ..... 123/458
5,842,454 A * 12/1998 Miwa et al. ..... 123/497
5,884,597 A * 3/1999 Hiraku et al. ..... 123/179.17
5,927,253 A * 7/1999 Oyafuso et al. ..... 123/456
5,937,826 A 8/1999 Olson et al.
5,992,373 A * 11/1999 Hosoya et al. ..... 123/305
6,024,064 A * 2/2000 Kato et al. ..... 123/179.17
6,065,436 A * 5/2000 Koga et al. ..... 123/179.17
6,269,801 B1 * 8/2001 Channing ..... 123/516
6,382,188 B2 * 5/2002 Hasegawa et al. ..... 123/491
6,408,822 B1 * 6/2002 Rembold et al. ..... 123/447
6,408,825 B1 * 6/2002 Enoki et al. ..... 123/467
6,415,770 B1 * 7/2002 Kojima ..... 123/511
6,578,555 B2 6/2003 Sykes
6,659,085 B2 * 12/2003 Kojima ..... 123/456
6,761,151 B2 * 7/2004 Kojima ..... 123/458
6,918,367 B2 * 7/2005 Denz et al. ..... 123/179.17
7,066,126 B2 * 6/2006 Tokuyasu et al. ..... 123/179.17
7,089,914 B2 * 8/2006 Joos et al. ..... 123/456
7,093,576 B2 * 8/2006 DeRaad ..... 123/179.17
7,134,413 B2 * 11/2006 Cho ..... 123/179.17
7,143,747 B2 * 12/2006 Uchiyama ..... 123/456

(Continued)

FOREIGN PATENT DOCUMENTS

DE 10240069 3/2003

(Continued)

*Primary Examiner*—Thomas N Moulis
(74) *Attorney, Agent, or Firm*—Allan J. Lippa; Alleman Hall McCoy Russell & Tuttle LLP

(57) ABSTRACT

An engine system and a method of starting an internal combustion engine of the engine system are described. In one embodiment, the method includes adjusting a fuel pressure within a fuel rail to exceed a pressure of a pressure relief valve. The method may be particularly useful during degradation of a fuel pressure sensor.

20 Claims, 6 Drawing Sheets

U.S. PATENT DOCUMENTS 7,281,509 B2 * 10/2007 Fukui et al. ..... 123/179.16
7,308,880 B2 * 12/2007 Katayama et al. ..... 123/179.4
7,383,804 B2 * 6/2008 Wolber et al. ..... 123/179.16
7,412,953 B2 * 8/2008 Shimazaki et al. ..... 123/179.16
7,596,447 B2 * 9/2009 Oono ..... 701/114
2007/0246021 A1 10/2007 Takayanagi et al.
2007/0251502 A1 11/2007 Takayanagi et al.
2009/0111338 A1 * 4/2009 Fujino et al. ..... 440/1

FOREIGN PATENT DOCUMENTS

DE 102005001922 12/2005

* cited by examiner

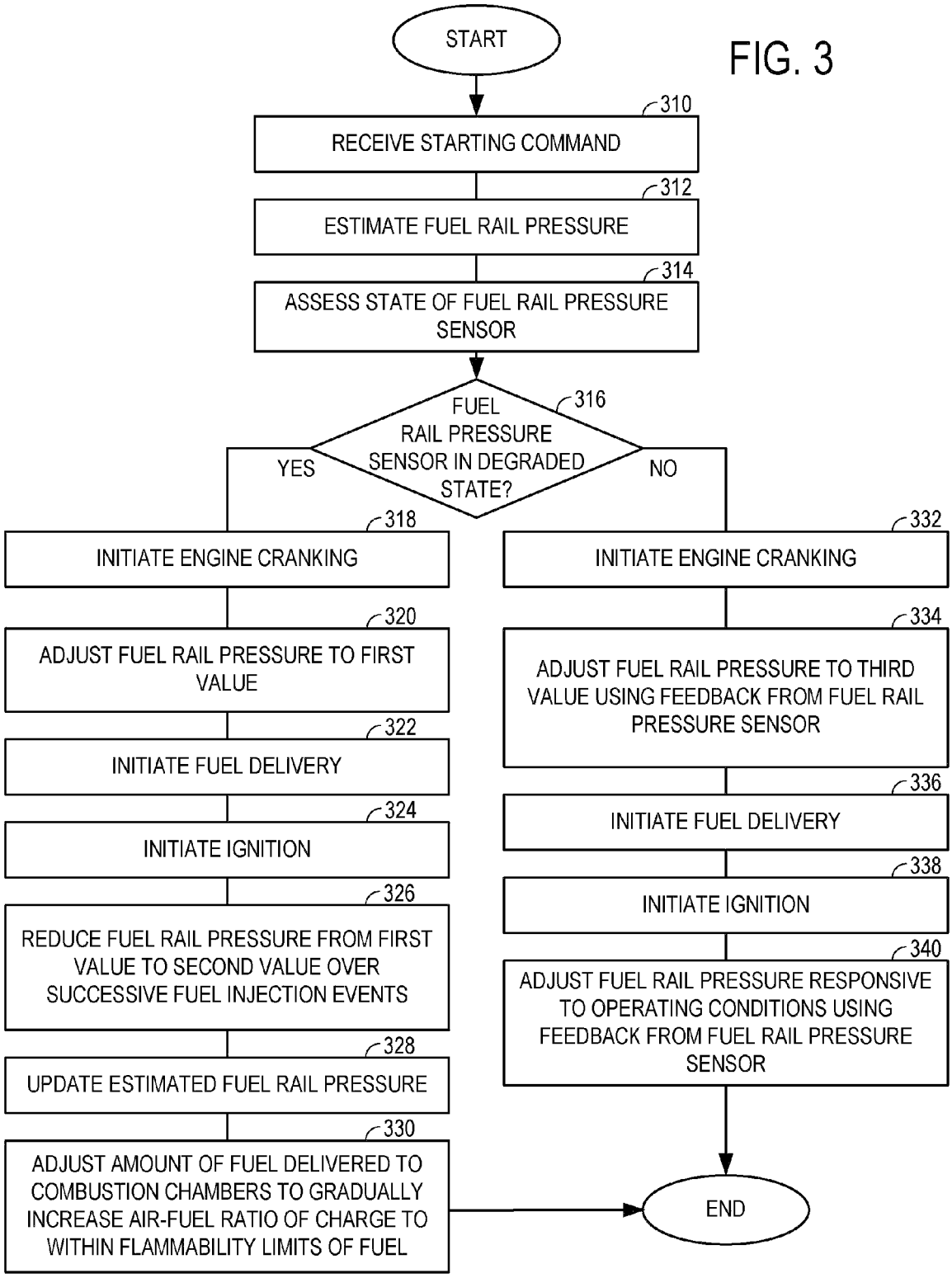
START
FIG. 3
310
RECEIVE STARTING COMMAND
312
ESTIMATE FUEL RAIL PRESSURE
314
ASSESS STATE OF FUEL RAIL PRESSURE SENSOR
316
FUEL RAIL PRESSURE SENSOR IN DEGRADED STATE?
YES
NO
318
INITIATE ENGINE CRANKING
320
ADJUST FUEL RAIL PRESSURE TO FIRST VALUE
322
INITIATE FUEL DELIVERY
324
INITIATE IGNITION
326
REDUCE FUEL RAIL PRESSURE FROM FIRST VALUE TO SECOND VALUE OVER SUCCESSIVE FUEL INJECTION EVENTS
328
UPDATE ESTIMATED FUEL RAIL PRESSURE
330
ADJUST AMOUNT OF FUEL DELIVERED TO COMBUSTION CHAMBERS TO GRADUALLY INCREASE AIR-FUEL RATIO OF CHARGE TO WITHIN FLAMMABILITY LIMITS OF FUEL
332
INITIATE ENGINE CRANKING
334
ADJUST FUEL RAIL PRESSURE TO THIRD VALUE USING FEEDBACK FROM FUEL RAIL PRESSURE SENSOR
336
INITIATE FUEL DELIVERY
338
INITIATE IGNITION
340
ADJUST FUEL RAIL PRESSURE RESPONSIVE TO OPERATING CONDITIONS USING FEEDBACK FROM FUEL RAIL PRESSURE SENSOR
END

ADDRESSING FUEL PRESSURE UNCERTAINTY DURING STARTUP OF A DIRECT INJECTION ENGINE

BACKGROUND AND SUMMARY

Internal combustion engines may include a fuel rail for distributing fuel to one or more fuel injectors. A pressure of the fuel within the fuel rail may be identified from a fuel rail pressure sensor. The fuel injectors may be operated to inject fuel over a fuel injection pulse-width that is selected, based on the pressure of the fuel within the fuel rail as identified by the fuel rail pressure sensor, to obtain a suitable air-fuel ratio for ignition.

The inventors herein have recognized that degradation of the fuel rail pressure sensor, including sensor failure, may cause uncertainty as to the pressure of the fuel within the fuel rail. As such, a deviation in the amount of fuel injected by the fuel injectors may occur as a result of this uncertainty. United States published patent application number 2007251502 attempts to address this issue by determining whether a pressure sensor is in an abnormal operation state. If the pressure sensor is determined to be in an abnormal operation state, then a duty of a pulse width modulation signal for a fuel pump is fixedly maintained at 100%.

However, the inventors herein have recognized a further disadvantage with the above approach. For example, if the fuel pump is continuously operated at a high pressure setting in response to an abnormal pressure sensor as taught by US 2007251502, then minimum pulse width constraints associated with the fuel injectors may cause an air-fuel ratio formed in the combustion chambers of the engine to be overly rich under some conditions. This deviation in the fuel injection amount may cause excessively rich combustion leading to spark plug fouling during attempted start-up of the internal combustion engine, increased levels of combustion products, and reduced engine efficiency.

To address these or other issues, the inventors have provided an engine system and a method which enables starting of the engine system with a higher fuel pressure to obtain better fuel atomization while also enabling subsequent operation of the engine with a lower fuel pressure even if the fuel pressure sensor is in a degraded state. In one embodiment, the method includes adjusting a fuel pressure within a fuel rail to a first value by operating a high pressure fuel pump to provide pressurized fuel to a high pressure regulation device that exceeds a pressure relief setting of the high pressure regulation device. After the fuel pressure within the fuel rail attains the first value, the method further includes initiating delivery of fuel to the internal combustion engine from the fuel rail by successively injecting fuel directly into combustion chambers of the internal combustion engine. After at least a first fuel injection event, the method includes reducing the fuel pressure within the fuel rail from the first value to a second value over subsequent successive fuel injection events by adjusting an operating parameter of the high pressure fuel pump.

In this way, a higher fuel pressure may be initially obtained to provide increased fuel vaporization and a lower fuel pressure may be thereafter obtained to provide reduced variability in the fuel injection amount at lower engine load conditions, such as at engine idle. This reduced variability may serve to decrease the likelihood of spark plug fouling that may otherwise occur during start-up of the internal combustion engine with a degraded fuel rail pressure sensor. Furthermore, by optionally increasing the air-fuel ratio over successive fuel injection events while the fuel rail pressure is decreasing, the likelihood of spark plug fouling may be further reduced in the event of a failed or degraded fuel rail pressure sensor.

BRIEF DESCRIPTION OF THE DRAWINGS

FIGS. 3 and 4 show example embodiments of methods of starting the engine system of FIG. 1.

DETAILED DESCRIPTION

Figure 1:
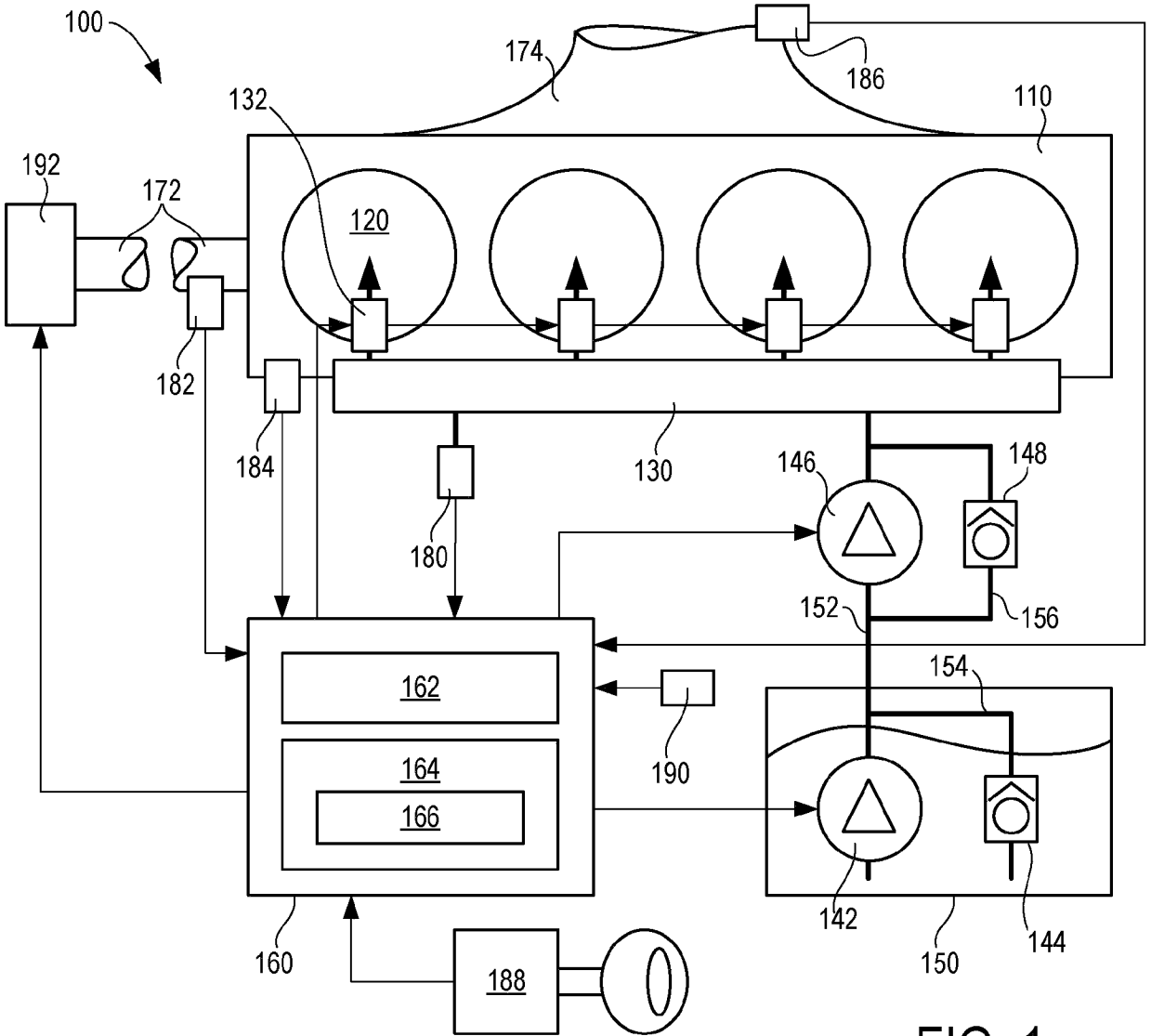
FIG. 1 schematically shows an example embodiment of an engine system.

FIG. 1 schematically shows an example embodiment of an engine system 100. Engine system 100 includes an internal combustion engine 110 having one or more combustion chambers. An example combustion chamber 120 is shown in FIG. 1 and is shown in greater detail in FIG. 2. Each combustion chamber of internal combustion engine 110 may include a fuel injector for delivering fuel thereto. In some embodiments, each combustion chamber may include a direct fuel injector configured to inject fuel directly into that combustion chamber. For example, combustion chamber 120 may include direct fuel injector 132.

Engine system 100 may include a fuel rail 130 that is configured to distribute fuel to the fuel injectors, including direct fuel injector 132. Fuel may be supplied to fuel rail 130 from fuel tank 150 via a fuel passage 152. Fuel passage 152 may include one or more fuel pumps. For example, fuel passage 152 may include a low pressure fuel pump 142 and a high pressure fuel pump 146.

Fuel passage 152 may include one or more pressure regulation devices for regulating a pressure of the fuel within a particular region of fuel passage 152. As a non-limiting example, a low pressure regulation device 144 may be provided along a first fuel regulation passage 154 and a high pressure regulation device 148 may be provided along a second fuel regulation passage 156.

First fuel regulation passage 154 may communicate with fuel passage 152 downstream of low pressure fuel pump 142 so that the fuel pressure provided at an output of low pressure fuel pump 142 may be regulated to a value that is prescribed by low pressure regulation device 144. In some embodiments, low pressure regulation device 144 may include a mechanical or electromechanical check valve or pressure relief valve. In some embodiments, low pressure regulation device 144 may include a fuel pressure regulator. As a non-limiting example, low pressure regulation device 144 may be configured to limit a pressure of the fuel downstream of low pressure fuel pump 142 to approximately 0.4 MPa. However, it should be appreciated that low pressure regulation device 144 may be configured to limit the pressure downstream of low pressure fuel pump 142 to other suitable values.

A second fuel regulation passage 156 may communicate with fuel passage 152 downstream of high pressure fuel pump 146 so that fuel pressure provided at an output of high pressure fuel pump 146 may be regulated to a value that is prescribed by high pressure regulation device 148. In some embodiments, high pressure regulation device 148 may include a mechanical or electromechanical check valve, or a fuel pressure regulator. In some embodiments, high pressure regulation device 148 in combination with low pressure regulation device 144 may be configured to limit a pressure of the fuel in fuel passage 152 downstream of high pressure fuel pump 146 to approximately 19.5 MPa. As such, high pressure regulation device 148 may have a higher pressure regulation setting than low pressure regulation device 144. However, it should be appreciated that high pressure regulation device 148 may be configured to limit the pressure downstream of high pressure fuel pump 146 to other suitable values.

Engine system 100 may include a control system 160. Control system 160 may include a processor 162 and memory 164. Memory 164 may be configured to hold or store executable instructions 166 that, when executed by processor 162, causes the processor to perform one or more of the various methods or processes described herein.

As one example, control system 160 may be configured to adjust an operating parameter of low pressure fuel pump 142 and high pressure fuel pump 146 to vary a pressure of fuel provided to fuel rail 130 by each pump. As another example, control system 160 may be configured to adjust a pressure regulation setting of one or more of low pressure regulation device 144 and high pressure regulation device 148 to vary a pressure at which the fuel is provided to fuel rail 130, such as where devices 144 or 144 include electromechanical check valves or electromechanical pressure regulators that enable their pressure settings to be adjusted. As will be described in the context of the process flow or methods of FIG. 3, control system 160 may be configured to vary the pressure of fuel provided to fuel rail 130 by adjusting one or more of the fuel pumps or the pressure regulation devices in response to operating conditions associated with engine system 100.

As yet another example, control system 160 may control activation of the fuel injectors, including direct fuel injector 132 to vary an amount of fuel that is injected into the combustion chambers, including combustion chamber 120. For example, control system 160 may be configured to vary a pulse-width of direct fuel injector 132 in response to operating conditions associated with engine system 100. Control system 160 may also activate or deactivate a starting motor 192 in response to operating conditions associated with engine system 100. Starting motor 192 may be operatively coupled to crankshaft 172 and may be configured to rotate crankshaft 172 when activated by control system 160.

Control system 160 may also receive an indication of the various operating conditions associated engine system 100 from various sensors, including a fuel rail pressure sensor 180 which provides an indication of a pressure of fuel within fuel rail 130, a crankshaft sensor 182 which provides an indication of engine rotational speed and/or rotational position with respect to crankshaft 172 of internal combustion engine 110, an engine temperature sensor 184 which provides an indication of a temperature of internal combustion engine 110, an exhaust gas composition sensor 186 which provides an indication of exhaust gas composition flowing through exhaust passage 174 of internal combustion engine 110, an ignition sensor 188 which provides an indication of an ignition key position or a user selected setting of any suitable user input device for enabling a user to start the internal combustion engine, and an ambient temperature sensor 190 which provides an indication of ambient temperature to the control system. In some embodiments, exhaust gas composition sensor 186 may include an exhaust oxygen sensor which can provide control system 160 with an indication of an air-fuel ratio of an air and fuel charge that was combusted at the combustion chambers of internal combustion engine 110.

Figure 2:
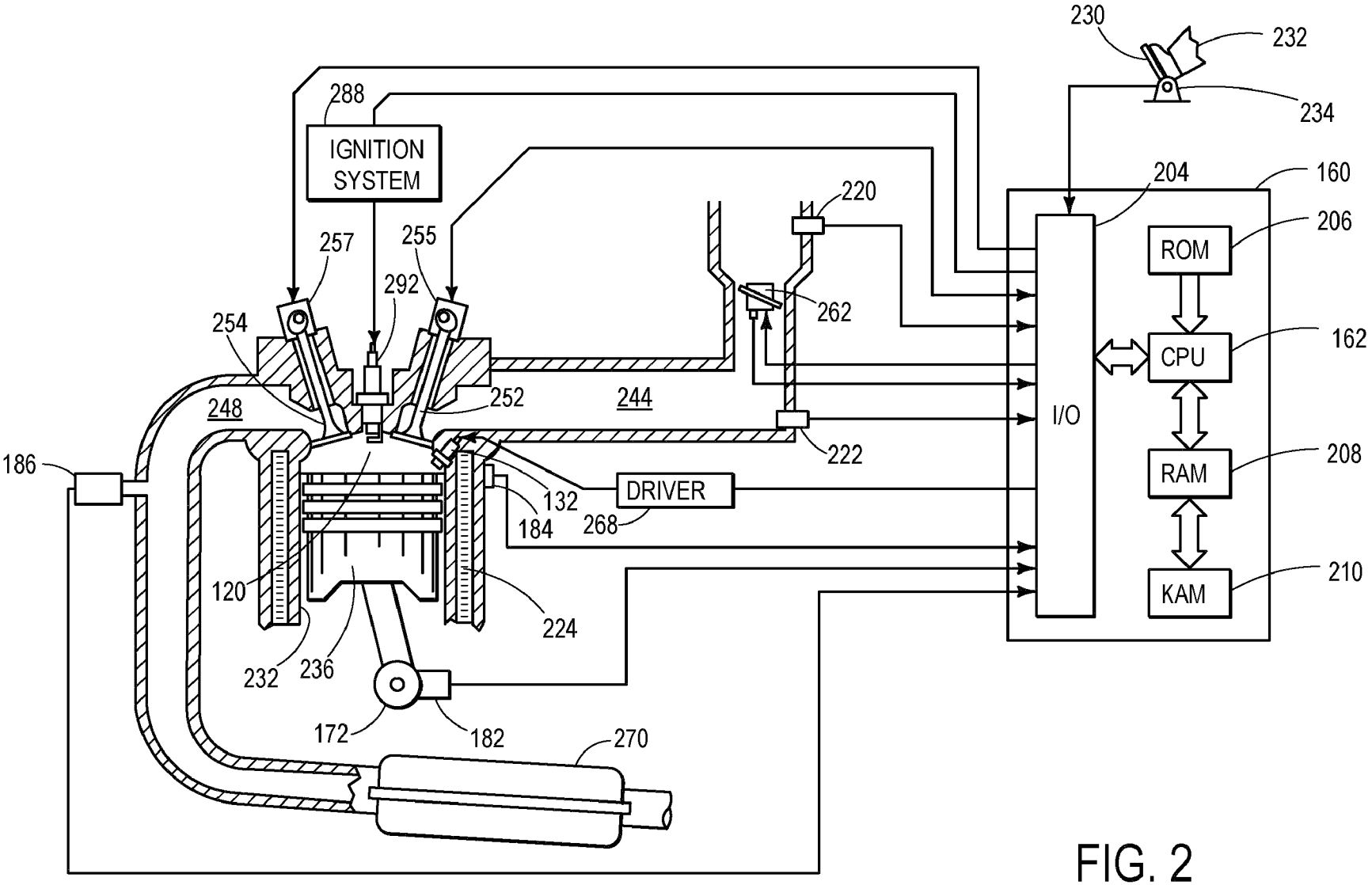
FIG. 2 schematically shows an example combustion chamber of the engine system of FIG. 1.

FIG. 2 schematically shows a non-limiting example of combustion chamber 120 of engine system 100 of FIG. 1. Combustion chamber 120 is partially defined by one or more of combustion chamber walls 232, piston 236, intake valve 252, and exhaust valve 254. Piston 236 is operatively coupled to crankshaft 172. Combustion chamber walls 232 include a cooling sleeve 224. In some embodiments, engine temperature sensor 184 may be configured to measure a temperature of a cooling fluid within cooling sleeve 224.

Intake valve 252 may be opened and closed by valve activation device 255 to admit intake air received via an intake passage 244 into combustion chamber 120. In some embodiments, combustion chamber 120 may include two or more intake valves. Exhaust valve 254 may be opened and closed by valve activation device 257 to exhaust combustion gases from combustion chamber 120 into exhaust passage 248. In some embodiments, combustion chamber 120 may include two or more exhaust valves. Valve activation devices 255 and 257 may include cam actuators or electromagnetic valve actuators. In some embodiments, control system 160 may be configured to vary an opening and closing timing of the intake and exhaust valves via their respective valve actuation devices in response to operating conditions associated with the engine system.

Intake passage 244 may supply intake air to two or more combustion chambers of internal combustion engine 110, including combustion chamber 120. Similarly, exhaust passage 248 may exhaust combustion gases from two or more combustion chambers of internal combustion engine 110, including combustion chamber 120. Intake passage 244 may include an intake throttle 262, the position of which may be adjusted by control system 160 in response to operating conditions associated with the engine system. Exhaust passage 248 may include an exhaust after treatment device 270.

A fuel injection pulse width of direct fuel injector 132 may be adjusted by control system 160 via an electronic driver 268. A spark plug 292 may be optionally provided at combustion chamber 120. A spark timing provided by spark plug 292 may be activated to issue an ignition spark by control system 160 via an ignition system 288. In some embodiments, ignition system 288 and electronic driver 268 may form part of control system 160. Intake passage 244 may include a mass airflow sensor 220 and a manifold air pressure sensor 222 in some embodiments. Control system may also receive user input from a user 232 via an accelerator pedal 230 including a pedal position sensor 234 (e.g., where engine system 100 is provided for an automobile).

A non-limiting example of control system 160 is provided in FIG. 2. In this particular example, control system 160 is depicted to include various forms of memory communicating with processor 162, including read-only memory 206, random access memory 208, and keep-alive memory 210. Further, control system 160 is shown including an input/output interface 204 through which processor 162 may communicate with the previously described sensors or actuators of FIGS. 1 and 2.

Some engine systems, including gasoline direct injection (GDI) systems may rely on a fuel rail pressure sensor to control the fuel quantity that is injected into the combustion chambers of the internal combustion engine. In the case of a degradation (e.g., failure) of the fuel rail pressure sensor, these systems may have two "open loop" pressures that are available, including a minimum pressure or low pressure setting (LPS) (e.g., 0.4 MPa) that is provided by a low pressure regulation device (e.g., 142 of FIG. 1) and a maximum pressure or high pressure setting (HPS) (e.g., 19.4 MPa) that is provided by a high pressure regulation device (e.g., 146 of FIG. 1). Further, some engine systems may be configured to depressurize the system or switch to a default mechanically-regulated pressure that is provided by a pressure regulation device in the case where fuel rail pressure sensor degradation occurs.

When the internal combustion engine is shut-off (e.g., not carrying out combustion), the fuel may warm toward engine coolant temperature. For a first period of time after shut-off (e.g., for a period of approximately 20 minutes) the fuel rail temperature may increase and after that it may fall for hours toward ambient temperature. Since the fuel rail may be maintained as a closed, rigid container by one or more pressure regulation devices, the fuel rail pressure may increase as the fuel contained therein attempts to expand with increasing fuel rail temperature. After this first period of time after shut-off where fuel heating occurs, the fuel may begin to cool. At this point, the fuel rail temperature may be essentially isothermal with engine coolant temperature. As the fuel rail temperature cools, the fuel rail pressure may drop toward fuel vapor pressure. Thus, during the shut-off period of the internal combustion engine, the fuel rail pressure may be as high as the HPS (e.g. 19.5 MPa) and may be as low as fuel vapor pressure (less than 0.1 MPa, absolute). This range of possible fuel rail pressures may provide a source of uncertainty as to the actual fuel rail pressure if the fuel rail pressure sensor becomes degraded.

In some embodiments, if the fuel rail pressure sensor fails during operation of the internal combustion engine, a transition to the above described open loop pressure may be performed without engine stall. It can only be performed without stall if we program an estimate of fuel pressure based on pump and injector operation. A pump fully on drives the pressure to the high limit of mechanically regulated pressure. A pump fully off drives the fuel rail pressure to lift pump pressure as fuel injection occurs. By knowing how the pump and the injectors are being controlled, one can compute the expected fuel mass gain in the fuel rail. Given the mass change the pressure change is directly computed from the effective bulk modulus and fuel rail volume. Whatever one uses as a fuel rail estimate, it needs to be updated knowing the rate mass change in the fuel rail. Guessing initial fuel rail pressure high results in rich error and guessing low results in lean error. But a running engine often gets close to a usable estimate quick enough to avoid engine stall.

However, GDI engines and other direct injection internal combustion engines may be more susceptible to spark plug fouling during an attempted engine start if the air-fuel ratio of the air and fuel charge that is provided to the combustion chambers is outside of the flammability limits of the fuel. For example, if an estimated fuel pressure results in an air-fuel ratio of the air and fuel charge that is too rich at start-up (e.g., the air-fuel ratio is overly rich), spark plug fouling may occur.

In addition to the above issues, suitable atomization or vaporization of the injected fuel may be difficult to achieve during start-up of the internal combustion engine since the temperature of the internal combustion engine at start-up may be substantially less than the temperature at some period after start-up has occurred. Therefore, higher fuel injection pressures may be desirable at start-up to achieve suitable atomization or vaporization of the fuel. However, these higher fuel pressures may increase variability of fueling the internal combustion engine after start-up, particularly at lower load operation. As such, it is desirable to provide a fuel rail pressure that is initially high to provide increased fuel vaporization and atomization followed by a lower fuel rail pressure to provide reduced variability in the amount of fuel delivered to the internal combustion engine. These different fuel rail pressure targets may be difficult to achieve, particularly if the fuel rail pressure sensor has been degraded.

FIG. 3 shows an example embodiment of a method for starting the engine system of FIG. 1. While the method of FIG. 3 will be described in the context of the engine system of FIG. 1, it should be appreciated that the method of FIG. 3 may be applied to other suitable engine systems. Furthermore, while the following method of FIG. 3 will be described along with a variety of optional and/or alternative processes, this method may include one or more of the following operations, depending on the particular starting sequence that is used: 1) estimating a fuel rail pressure during start-up of the engine based operating conditions at shut-off of the engine and a period of time that the engine has been shut-off (however a fuel rail pressure estimate may not be used in some embodiments if a fuel pump is operated to increase the fuel rail pressure to beyond a pressure relief setting of a pressure regulation device before fuel injection is initiated), 2) adjusting the fuel rail pressure to a first value that corresponds to a pressure relief setting of one or more pressure regulation device before the delivery of fuel is initiated at start-up to enable reliable fuel pressure identification, 3) reducing the fuel rail pressure from the first value to a lesser second value after fuel delivery to the internal combustion engine has been initiated at the first value (e.g., by turning off the high pressure fuel pump or by permitting the mass flow of fuel passing through the high pressure pump to be outstripped by the amount of fuel delivered to the engine by the fuel injectors), and 4) after fuel delivery is initiated, adjusting an amount of fuel delivered to the combustion chambers to gradually increase an air-fuel ratio of the air and fuel charge delivered to the combustion chambers to within the flammability limits of the fuel (which may not be performed in some embodiments unless a minimum fuel rail pressure is assumed for purposes of selecting a fuel injection amount).

Referring to 310 of FIG. 3, the method may include receiving a starting command for the internal combustion engine. As one example, control system 160 may receive an indication of key-on from ignition sensor 188 in response to a user or operator of the engine system turning a key from an "off" position to an "on" position. It should be appreciated that in other embodiments, key-on may be provided by a user pressing a button, flipping a switch, or through other suitable user input. As another example, engine system 100 may be utilized as part of a hybrid vehicle propulsion system or a "stop-start" vehicle where internal combustion engine 110 is periodically stopped and restarted to conserve fuel. A starting command may be issued by the control system in response to operating conditions associated with the engine system, such as a battery state of charge, a tip-in initiated by the user via accelerator pedal 230, or other suitable operating condition. As such, the starting command may be received at the control system based on user input or based on automated control of engine starting by the control system.

It should be appreciated that due to the configuration of some fuel systems (e.g., as depicted in FIG. 1), fuel may be retained in the fuel rail after the engine system is shut-off. For example, pressurized fuel may be retained in fuel rail 130 by pressure regulation device 148. Further, it should be appreciated that high pressure fuel pump 146 and low pressure fuel pump 142 may each include check valves that inhibit fuel flow from the downstream side of the pump to the upstream side of the pump, thereby also serving to retain fuel in the fuel rail.

At 312, a pressure of fuel within the fuel rail (a fuel rail pressure) may be estimated independent of an indication of fuel rail pressure provided by fuel rail pressure sensor 180. As a non-limiting example, control system 160 may be configured to estimate the fuel rail pressure using one or more of the following approaches.

In some embodiments, during operation of the internal combustion engine (prior to the present starting operation), the control system may maintain an estimate of a temperature of the fuel within the fuel rail (a fuel rail temperature). This estimate may be a function of one or more of the following factors: an ambient temperature which can provide an estimate of a temperature of the fuel within the fuel tank, an engine coolant temperature provided by engine temperature sensor 184 which can provide an indication of the temperature of internal combustion engine 110 near the fuel rail, and a fuel consumption rate of the internal combustion engine which provides an indication of a flow rate of the fuel through the fuel rail. For example, based on one or more of the above factors, the control system may estimate that the temperature of the fuel within the fuel rail approaches the engine coolant temperature at lower fuel flow rates and approaches the ambient temperature or fuel tank temperature at higher fuel flow rates.

In some embodiments, at key-off or shut-off of the internal combustion engine, the last estimate of the fuel rail temperature may be stored in memory (e.g., memory 164) by the control system. Further, at key-off or shut-off of the internal combustion engine, the control system may begin measuring a time since the key-off or shut-off by activating a time-since-key-off timer. For example, this time-since-key-off timer may be represented as instructions 166 held in memory 164 and may be executed by processor 162 at shut-off of the internal combustion engine. For example, in some embodiments, a fuel rail pressure may be inferred after shut-off of the internal combustion engine, where the fuel rail pressure is known to initially climb (e.g., due to fuel heating within the fuel rail) at a rate no less than a lower bound rate and at a rate now more than an upper bound rate. As another example, after even longer periods of time after shut-off of the engine, the fuel within the fuel rail pressure may cool-off to a temperature where the fuel resides in the fuel rail at fuel vapor pressure, which can provide yet another reliable estimate of fuel rail pressure after shut-of the engine.

In some embodiments, such as where engine system is maintained in an active state while internal combustion engine 110 is shut-off, such as where engine system 100 is part of a hybrid vehicle propulsion system or a stop-start vehicle, the control system may continue estimating the fuel rail temperature based on temperature feedback from one or more temperature sensors without utilizing the previously described time-since-key-off timer. Further, in some embodiments, the control system may utilize a direct measurement of fuel rail temperature obtained from a fuel rail temperature sensor, which may also be represented schematically at 180 in FIG. 1.

As a first non-limiting example, if the engine coolant temperature (ENGINE_COOLANT_TEMPERATURE) is cooler than the fuel rail temperature at key off (FUEL_RAIL_TEMPERATURE_KEY_OFF), then the control system may judge that fuel rail cooling has occurred. As such, if (ENGINE_COOLANT_TEMPERATURE<FUEL_RAIL_TEMPERATURE_KEY_OFF)

Then the estimated fuel rail pressure (ESTIMATED_FUEL_PRESSURE) is governed by the lift pump pressure (LIFT_PUMP_PRESSURE).

ESTIMATED_FUEL_PRESSURE=LIFT_PUMP_PRESSURE−10 psi

As another non-limiting example, when at least 20 minutes (or other suitable period of time) have elapsed since the internal combustion engine has been shut-off, the following approach may be used to estimate the fuel rail pressure at the next key-on. The control system may assume that the estimated fuel rail temperature (ESTIMATED_FUEL_TEMPERATURE) is approximately equal to the engine coolant temperature identified from engine temperature sensor 184.

As such, a rise in the fuel rail temperature (FUEL_RAIL_TEMPERATURE_RISE) is then equal to the difference between the fuel rail temperature at the previous engine shutdown (FUEL_RAIL_TEMPERATURE_KEY_OFF and the estimated fuel temperature (ESTIMATED_FUEL_TEMPERATURE):

FUEL_RAIL_TEMPERATURE_RISE=FUEL_RAIL_TEMPERATURE_KEY_OFF−ESTIMATED_FUEL_TEMPERATURE

Further, the estimated fuel pressure at the previous engine shutdown (ESTIMATED_FUEL_PRESSURE_KEY_OFF) is then equal to the product of the fuel rail temperature rise, the coefficient of thermal expansion of the fuel (FUEL_COEFFICIENT_OF_THERMAL_EXPANSION) and the effective bulk modulus of the fuel rail (EFFECTIVE_FUEL_RAIL_BULK_MODULUS):

ESTIMATED_FUEL_PRESSURE_KEY_OFF=(FUEL_RAIL_TEMPERATURE_RISE*FUEL_COEFFICIENT_OF_THERMAL_EXPANSION)*EFFECTIVE_FUEL_RAIL_BULK_MODULUS

As an example, the FUEL_COEFFICIENT_OF_THERMAL_EXPANSION is equal to 0.001 per degree C. and the EFFECTIVE_FUEL_RAIL_BULK_MODULUS is equal to 700 MPa.

Finally, the estimated fuel pressure is then equal to the greater of the lift pump pressure (LIFT_PUMP_PRESSURE)−10 psi and the estimated fuel pressure at the previous engine shutdown:

ESTIMATED_FUEL_PRESSURE=max((LIFT_PUMP_PRESSURE−10 psi), ESTIMATED_FUEL_PRESSURE_KEY_OFF))

As yet another non-limiting example, when less than 20 minutes (or other suitable period of time) has elapsed since the internal combustion engine has been shutdown, the following approach may be used to estimate the fuel rail pressure at the next key-on.

The fuel rail temperature rise is then equal to the following:

FUEL_RAIL_TEMPERATURE_RISE=(ENGINE_COOLANT_TEMPERATURE−FUEL_RAIL_TEMPERATURE_KEY_OFF)*(1−exp(−(TIME_SINCE_KEY_OFF/TIME_CONSTANT)).

The estimated fuel rail pressure at the previous engine shutoff is then equal to the following equation, at least while the fuel rail pressure is above fuel vapor pressure:

ESTIMATED_FUEL_PRESSURE_KEY_OFF=FUEL_RAIL_TEMPERATURE_RISE*FUEL_COEFFICIENT_OF_THERMAL_EXPANSION*EFFECTIVE_FUEL_RAIL_BULK_MODULUS

Finally, the estimated fuel rail pressure is equal to the following equation:

ESTIMATED_FUEL_PRESSURE=max((LIFT_PUMP_PRESSURE−10 psi), ESTIMATED_FUEL_PRESSURE_KEY_OFF))

In some embodiments, the estimated fuel rail pressure obtained at 312 may be greater than the actual fuel rail pressure as a result of fuel injector leakage or leakage through the high pressure fuel pump (e.g., through one or more check valves of the high pressure fuel pump) from its downstream side of fuel passage 152 to its upstream side of fuel passage 152. As such, the estimated fuel rail pressure may over estimate the actual fuel rail pressure. Hence, the estimated fuel rail pressure that may be used by the control system to control fuel injection amounts may result in an overall leaner air-fuel being formed in the combustion chambers than prescribed by the control system. This leaner air-fuel ratio of the air and fuel charge may be used advantageously to reduce the likelihood of spark plug fouling during start-up as will be described at 330.

At 314, the method may include assessing a state of the fuel rail pressure sensor. For example, the control system may be configured to identify whether the fuel rail pressure sensor is in a degraded state. The fuel rail pressure sensor may be detected to be an unreliable indicator of fuel rail pressure (e.g., degraded) during operation of the engine, from previous operation of the engine, or at the time of engine start. One objective may be to transition the engine system from working with a measured fuel rail pressure to working with a fuel rail pressure achieved in an alternate manner. One may achieve a "default pressure" by a number of ways including using a maximum fuel rail pressure relief valve (e.g., the high pressure regulation device) to regulate fuel rail pressure to a known high pressure or disabling the high pressure fuel pump (e.g., perform fuel volume control) so that the fuel rail pressure becomes a pressure that corresponds to the lift pump pressure (e.g., a value that is at or slightly less than lift pump pressure as a result of pressure drop through the fuel circuit).

In some embodiments, the control system may judge that the fuel rail pressure sensor is in a degraded state when it has stopped functioning or when it provides an indication of fuel rail pressure to the control system that deviates from the estimated fuel rail pressure by a predetermined amount. For example, the control system may determine whether the fuel pressure sensor is in a degraded state by comparing the estimated fuel rail pressure identified at 312 to the fuel rail pressure measured by the fuel rail pressure sensor. If the fuel rail pressure indicated by the fuel rail pressure senor deviates from the estimated fuel rail pressure by at least the predetermined amount, then the control system may assess the state of fuel rail pressure sensor as a degraded state. Conversely, the fuel rail pressure sensor may be assessed by the control system to be in a non-degraded state when the deviation of the fuel rail pressure as measured by the fuel rail pressure sensor is less than the predetermined amount relative to the estimated fuel rail pressure.

It should be appreciated that other approaches may be used to determine whether the fuel rail pressure sensor is in a degraded state. For example, electrical resistance or impedance sensing of the fuel rail pressure sensor may be performed by the control system to determine whether the measured resistance or impedance are within predetermined ranges indicative of a degraded or non-degraded state of the fuel rail pressure sensor. In some embodiments, the control system may limit engine output to a reduced output value (e.g., activate limp home mode) after starting the internal combustion engine if the fuel rail pressure sensor has been judged to be in a degraded state.

If the answer at 316 is judged yes (e.g., the fuel rail pressure sensor is degraded), then the process flow may proceed to 318. At 318, the method may include initiating engine cranking. For example, at 318, the control system may activate starting motor 192 to cause starting motor 192 to rotate crankshaft 172 of internal combustion engine 110.

At 320, the method may optionally include adjusting the fuel rail pressure to at least a first value. For example, the control system may operate one or more of low pressure fuel pump 142 and high pressure fuel pump 146 to provide pressurized fuel to fuel rail 130. Where high pressure fuel pump 146 is powered by crankshaft 172, the control system may adjust a pump stroke volume of the high pressure fuel pump of the crankshaft to increase or decrease a fuel pressure that is provided by high pressure fuel pump. Where low pressure fuel pump 142 is powered by an electric motor, the control system may adjust a speed of the electric motor to increase or decrease a fuel pressure provided by the low pressure fuel pump.

Figure 5:
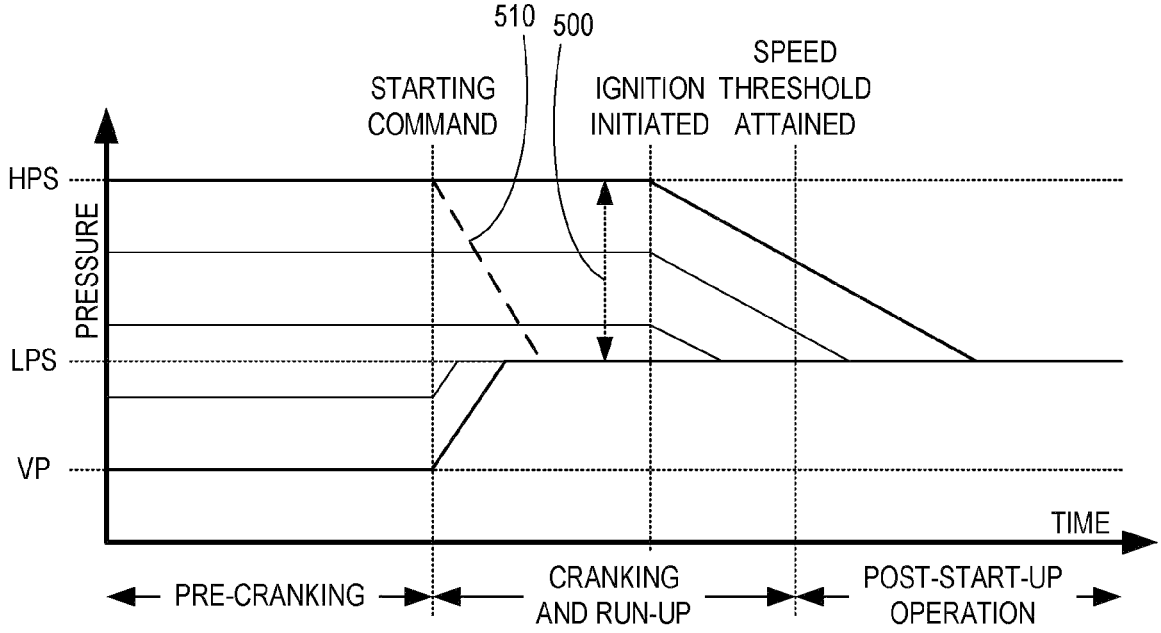
FIGS. 5-8 show graphs depicting examples of the method of FIG. 2 as applied to the engine system of FIG. 1.

As shown in FIGS. 5-8, the fuel rail pressure may be increased in some embodiments during the cranking and run-up phase of the engine starting operation. As shown in FIG. 5, the low pressure fuel pump may be operated at key-on or upon receiving the starting command to provide a fuel rail pressure that attains at least a low pressure setting (LPS), while the high pressure fuel pump is commanded by the control system to zero volume (e.g., minimum pump stroke volume) or other substantially low volume. For example, low pressure regulation device 144 may be configured to regulate the fuel rail pressure to the LPS. As a non-limiting example, the LPS may refer to a fuel rail pressure of approximately 0.4 MPa or other suitable value.

However, in some conditions, the fuel rail pressure may be greater than the LPS as a result of high pressure regulation device 148 being present in the fuel circuit which provides a high pressure setting (HPS). Therefore, until the high pressure fuel within the fuel rail has been consumed by the internal combustion engine, the fuel rail pressure may be higher than the LPS. Since the fuel rail pressure sensor has been judged to be in a degraded state, uncertainty as to the fuel rail pressure may exist, as indicated at 500 between the HPS and LPS. This uncertainty may be reduced by referencing the estimated fuel rail pressure obtained at 312.

In some embodiments, the control system may judge whether the fuel rail pressure estimated at 312 exceeds the first value (e.g., the LPS) before or during cranking of the internal combustion engine. If the fuel rail pressure exceeds the first value, then the control system may be configured to inject fuel into one or more of the combustion chambers during cranking or before cranking of the internal combustion engine is initiated, without igniting the fuel, in order to reduce the fuel rail pressure to the first value (e.g., the LPS in this example) before a first ignitable fuel injection is to be performed. The amount of fuel that is injected into each combustion chamber during each cycle with this approach may be adjusted to be less than an amount of fuel that may cause spark plug fouling. In this way, depressurization of the fuel rail may be performed (as indicated at 510) before initiating combustion in the internal combustion engine by delivering fuel to the combustion chambers to be exhausted to the exhaust passage via the exhaust valves during the power and/or exhaust strokes.

Figure 6:
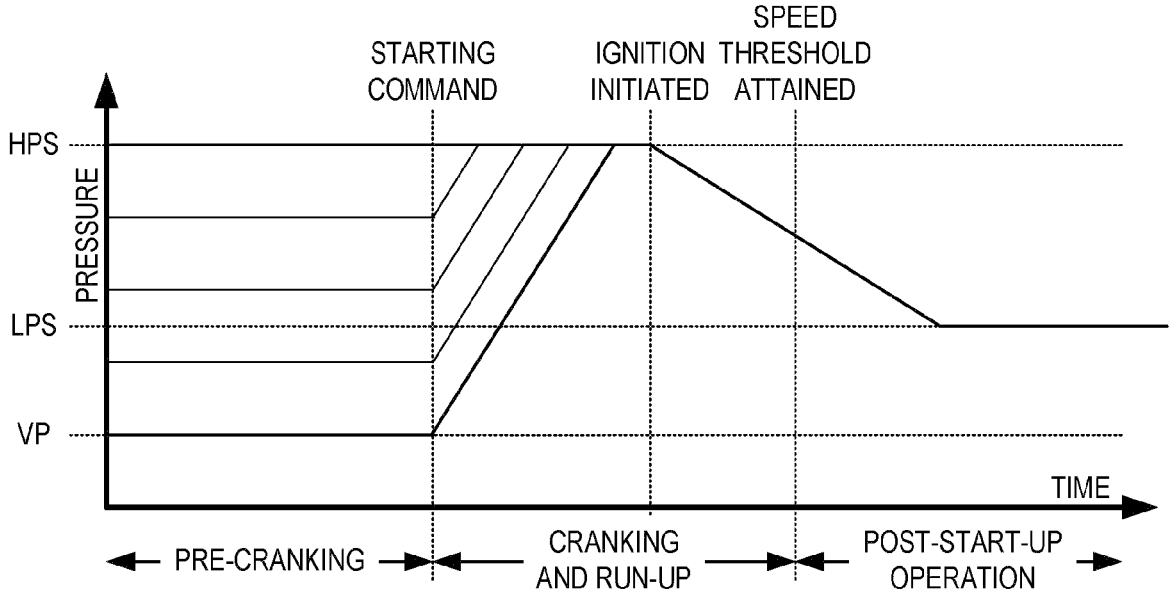

Alternatively, as shown in FIG. 6, the low pressure fuel pump and the high pressure fuel pump may be operated to provide a fuel rail pressure that attains the high pressure setting (HPS) provided by the presence of pressure regulation device 148 and pressure regulation device 144 in the fuel delivery circuit. For example, the high pressure fuel pump may be commanded to full volume by increasing the pump stroke volume to a maximum value or other suitably high pump stroke volume. As a non-limiting example, the HPS may refer to a fuel rail pressure of approximately 19.4 MPa or other suitable value. It should be appreciated that where the full pump volume corresponds to only a fraction of the fuel rail volume, the high pressure fuel pump may use multiple revolutions (e.g., 8 revolutions) of the crankshaft to build sufficient fuel pressure at the fuel rail.

Figure 7:
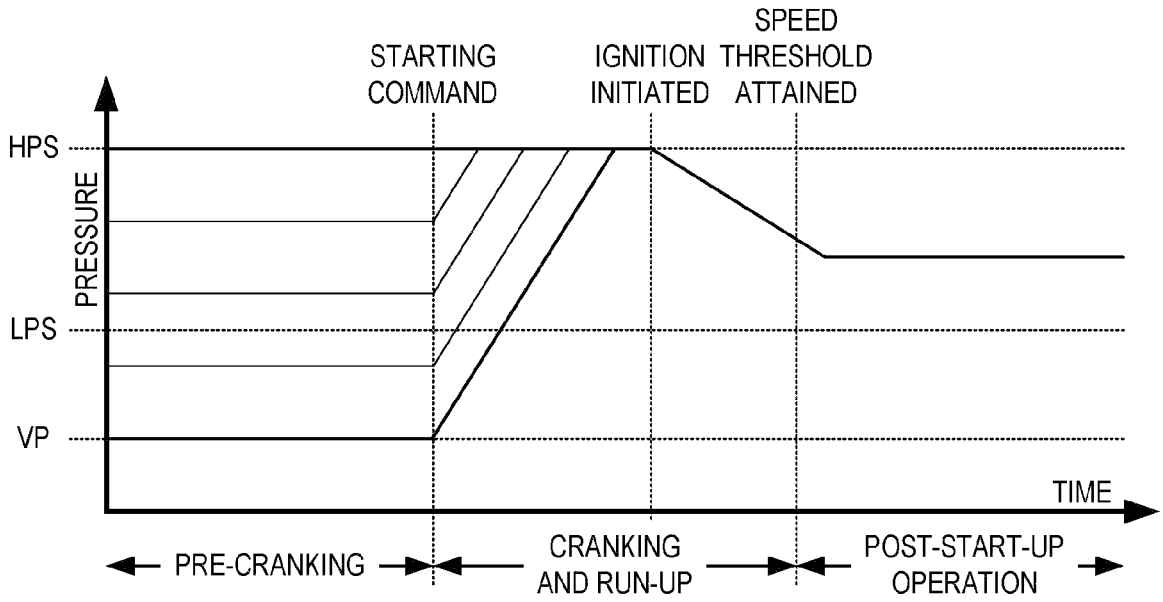
Figure 8:
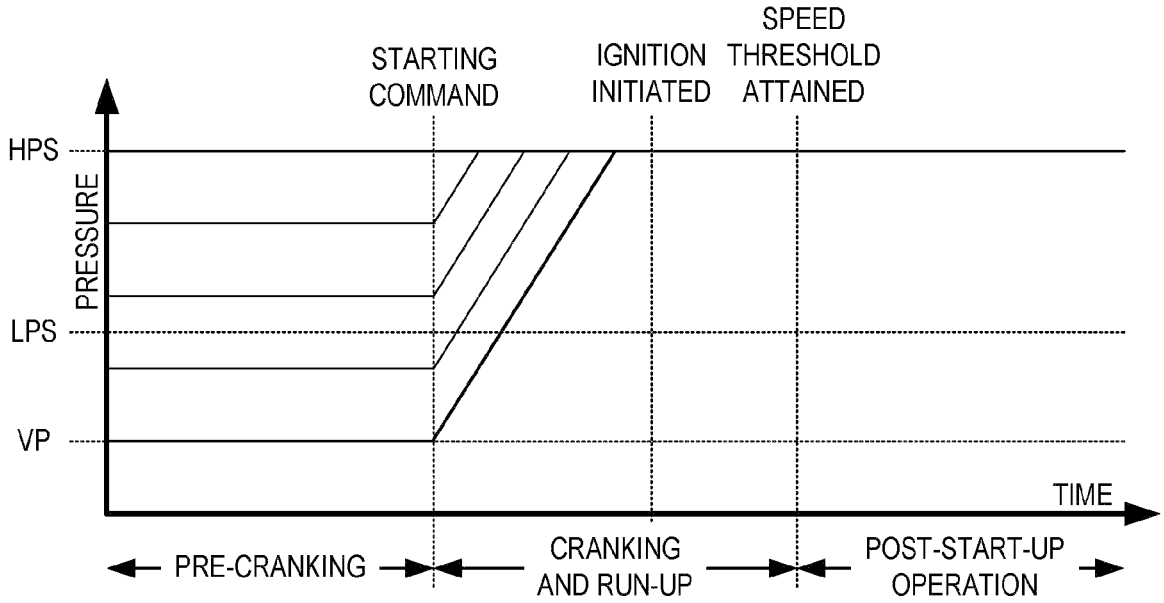

Since the high and low pressure fuel pumps are operated in the example of FIG. 6 to provide fuel to the fuel rail at a pressure that would otherwise exceed the HPS, the pressure regulation devices may be relied upon by the control system to limit the fuel rail pressure to the HPS. Thus, the uncertainty as to the fuel rail pressure may be substantially reduced when the first fuel injection is performed at the internal combustion engine. FIGS. 7 and 8 also show examples where the fuel rail pressure is increased to the HPS before the first fuel injection is performed.

In each of the above examples, the fuel rail pressure may be adjusted to the first value (e.g., either the LPS or the HPS) by commanding one or more of the high pressure fuel pump and low pressure fuel pump to a setting that provides a fuel pressure that exceeds a pressure relief setting of one or more of low pressure regulation device 144 and high pressure regulation device 148. In this way, the control system may achieve a consistent fuel rail pressure corresponding to the first value at the time of the first fuel injection without relying on feedback from the degraded fuel rail pressure sensor.

At 322, the method may include initiating fuel delivery to the internal combustion engine. For example, the control system may command the fuel injectors to successively inject fuel into the combustion chambers of the internal combustion engine. It should be appreciated that the order at which the fuel is injected into the various engine cylinders may be performed in accordance with a prescribed firing order of the internal combustion engine. In some embodiments, the control system may initiate fuel delivery at 322 only after the rotational speed of the crankshaft attains or exceeds a predetermined rotational speed as indicated by crankshaft sensor 182.

At 324, the method may include initiating ignition at the combustion chambers of the internal combustion engine. For example, the control system may command the spark plugs to provide a spark to the combustion chambers at a predetermined timing relative to the fuel injections initiated at 322 to ignite an air and fuel charge that was formed within the combustion chambers. It should be appreciated that the order at which the spark plugs are commanded to provide a spark to the combustion chambers may be performed in accordance with the firing order of the internal combustion engine.

At 326, after fuel delivery is initiated at 322, the method may include reducing the fuel rail pressure over successive fuel injection events from the first value to a second value that is less than the first value. In some embodiments, the fuel rail pressure may be reduced as a result of fuel being injected by the various fuel injectors at a greater rate than fuel is provided to the fuel rail via fuel passage 152.

For example, referring again to FIG. 5, since the fuel rail pressure is maintained at least at the LPS at the time of the first fuel injection by operation of the low pressure fuel pump while the high pressure fuel pump is command to zero pump stroke volume (or other suitable lower volume), the fuel rail pressure may be reduced from the estimated fuel rail pressure to the second value over the successive fuel injection events.

Referring again to FIG. 6, the fuel rail pressure may be reduced from the first value (which in this particular example is the HPS) to the second value (which is the LPS in this particular example). For example, the control system, after having commanded the high pressure fuel pump to a maximum pump stroke volume (or some other suitable volume for attaining the HPS), may command the high pressure fuel pump to a minimum pump stroke volume (e.g., zero volume or some other suitably low pump stroke volume) so that the fuel rail pressure attains the LPS over successive fuel injection events.

Referring to FIG. 7, the fuel rail pressure may be instead reduced from the first value (e.g., the HPS) to the second value that is greater than the LPS. In this example, the control system may temporarily adjust the pump stroke volume command of the high pressure fuel pump to provide less fuel to the fuel rail than the amount of fuel consumed by the engine until reaching an intermediate fuel rail pressure. Thereafter, the control system may adjust the pump stroke volume command of the high pressure fuel pump to match the amount of fuel consumed by the engine to maintain the intermediate fuel rail pressure.

In the example of FIG. 7, the control system may set a fuel rail pressure error to zero (no pressure feedback) in a fuel rail pressure feedback controller of the control system that may otherwise be used when the fuel rail pressure sensor is non-degraded. This fuel rail pressure controller can track the amount of fuel pumped by the high pressure fuel pump and the amount of injected fuel. Since the fuel injected out of the fuel rail increases when the estimated fuel rail pressure exceeds the actual fuel rail pressure, the error between the actual fuel rail pressure and the estimated fuel rail pressure does not integrate infinitely if the estimated fuel rail pressure is updated based on an estimate of the amount of fuel injected as will be described at 328. Similarly, when the actual fuel rail pressure exceeds the estimated fuel rail pressure, the error between the estimated and actual fuel rail pressures does not integrate infinitely.

In each of the example shown in FIGS. 5, 6, and 7, the fuel rail pressure may be reduced from the first value, after one or more initial fuel injections are performed, to a second value that is lower than the first value. Thus, the fuel rail pressure may be adjusted or reduced without feedback from the fuel rail pressure sensor. By reducing the fuel rail pressure, increased atomization or vaporization of the fuel may be initially achieved over the one or more initial fuel injections followed by a reduced fuel rail pressure that preserves low variability of the fuel injection amount, particularly at subsequent lower load operation (e.g., engine idle) that may occur after engine run-up. For example, as shown in each of FIGS. 5-8, the engine may be operated at idle upon attaining a prescribed speed threshold.

Referring to FIG. 8, the fuel rail pressure may be instead maintained at the HPS during operation of the engine (even after start-up), whereby the operation at 326 may be optionally omitted. In this way, the internal combustion engine may be operated at the HPS associated with the pressure relief setting of high pressure regulation device 148.

At 328, the fuel rail pressure estimated at 312 may be optionally updated to reflect decreasing fuel rail pressure caused by injecting fuel while the high pressure fuel pump is commanded to the minimum or substantially low pump stroke volume. For example, as shown in FIGS. 5, 6, and 7, the actual fuel rail pressure may be reduced over successive fuel injection events after fuel injection is initiated at 322. The control system may be configured to reduce the fuel rail pressure based on a known amount of fuel delivered with each fuel injection performed by the various fuel injectors as commanded by the control system.

At 330, after fuel delivery is initiated at 322, the method may include varying an amount of fuel that is directly injected into the combustion chambers over one or more of the subsequent successive fuel injection events after the delivery of fuel to the internal combustion engine is initiated to increase an air-fuel ratio of air and fuel charges formed in the combustion chambers relative to an air-fuel ratio of the first fuel injection event. In some embodiments, increasing the air-fuel ratio includes varying the amount of fuel that is directly injected into the combustion chambers over the successive fuel injection events responsive to the updated estimate of the fuel rail pressure (e.g., obtained at 328) as the fuel rail pressure is reduced from the first value to the second value (e.g., at 326). Furthermore, in some embodiments, increasing the air-fuel ratio includes maintaining the air-fuel ratio produced by any two consecutive fuel injection events to within a flammability limit of the fuel.

Further still, since the estimated fuel rail pressure obtained at 312 may include considerable uncertainty, fueling of the internal combustion engine may be performed in a way that reduces or minimizes spark plug fouling. As described above with respect to fuel system leakage, the actual fuel rail pressure may be less than the estimated fuel rail pressure, which causes less fuel to be injected by the control system as a result of the control system basing the fuel injection amount on the estimated fuel rail pressure rather than the measured fuel rail pressure from the fuel rail pressure sensor. As such, the initial fuel injection events may provide an air and fuel charge that is actually leaner than estimated by the control system, thereby providing an additional margin for error against spark plug fouling.

As such, the method at 328 may include fueling the combustion chambers based on the estimated fuel rail pressure or fueling lean of the estimated fuel rail pressure and then increasing the air-fuel ratio of the air and fuel charges over successive fueling events to enter the window of the flammability limits for the fuel from the lean side. In other words, the method at 328 may include creeping up on a fuel injection amount that produces an air-fuel ratio that is within the flammability limits of the fuel by assuming a high fuel rail pressure and ramping down the assumed pressure to keep any two consecutive injections within the flammability limits.

Returning to 316, if it is instead judged that the fuel rail pressure sensor is in a non-degraded state, the process flow may proceed to 332. At 332, engine cranking may be initiated and the fuel rail pressure may be adjusted by the control system (e.g., by the previously described fuel rail pressure controller) at 334 to a third value using feedback from the fuel rail pressure sensor. The third value may be the same as the first value or the second value described above, or may be any other suitable value. At 336, the control system may initiate fuel delivery at the internal combustion engine and may initiate ignition at 338. At 340, the fuel rail pressure may be optionally adjusted relative to the third value used at start-up responsive to operating conditions using feedback from the fuel rail pressure sensor. For example, the control system may reduce fuel rail pressure at idle using feedback from the fuel rail pressure sensor to control the high pressure fuel pump volume.

Figure 4:
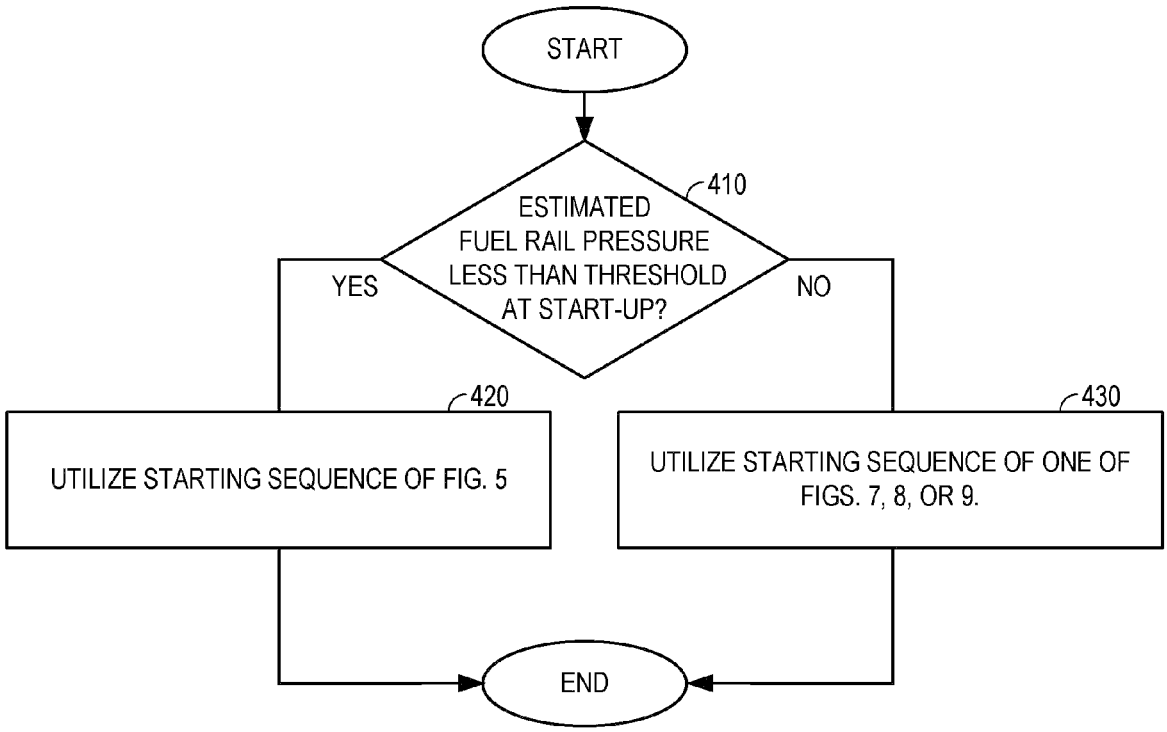

FIG. 4 shows an example embodiment of a method for starting the engine system of FIG. 1, and may be used in conjunction with the method of FIG. 3. At 410, the control system may judge whether the estimated fuel rail pressure is less than a threshold value at start-up. For example, the control system may compare the estimated fuel rail pressure obtained at 312 to a threshold value stored in memory. In some embodiments, the threshold value may correspond to the LPS as described above.

If the estimated fuel rail pressure is less than the threshold value, the process flow may proceed to 420. At 420, the starting sequence that was previously described with reference to FIG. 5 may be performed. For example, the low pressure fuel pump may be initially operated at key-on or upon receiving the starting command to provide a fuel rail pressure that attains at least a low pressure setting (LPS), while the high pressure fuel pump is commanded by the control system to zero pump stroke volume (e.g., minimum pump stroke volume) or other lower pump stroke volume.

Alternatively, if the estimated fuel rail pressure is not less than the threshold value, the process flow may proceed to 430. At 430, one of the starting sequences that were previously described with reference to FIG. 6, 7, or 8 may be performed. For example, the high pressure pump may be initially commanded to a higher pump stroke volume (e.g., a maximum pump stroke volume). From 420 or 430, the process flow may end or return.

The process flows of FIGS. 3 and 4 may be utilized alone or in combination to perform one or more of the following starting sequences. As one example, the method of starting an internal combustion engine includes adjusting a fuel pressure within a fuel rail to a first value by operating a high pressure fuel pump to provide pressurized fuel to a high pressure regulation device that exceeds a pressure relief setting of the high pressure regulation device. This operation may be performed in some embodiments if a state of a fuel rail pressure sensor is degraded. By contrast, if the state of the fuel rail pressure sensor is non-degraded, the method may instead include adjusting an operating parameter of the high pressure fuel pump to provide pressurized fuel to the high pressure regulation device that does not exceed the pressure relief setting responsive to feedback from the fuel rail pressure sensor.

The operation of operating the high pressure fuel pump to provide pressurized fuel to the high pressure regulation device that exceeds the pressure relief setting of the high pressure regulation device may include setting a pump stroke volume of the high pressure fuel pump to a maximum pump stroke volume, and may be performed responsive to a lower temperature state of the fuel rail. In some embodiments, responsive to a higher temperature state of the fuel rail, the method include setting the pump stroke volume of the high pressure fuel pump to a lesser pump stroke volume than the maximum pump stroke volume before the delivery of fuel to the internal combustion engine is initiated.

In some embodiments, the method may further include varying a number of pump strokes performed by the high pressure pump before initiating the delivery of fuel to the internal combustion engine responsive to one or more of a temperature of the internal combustion engine and a period of time since the internal combustion engine has been previously shut-off. For example, the delivery of fuel to the internal combustion engine may be initiated after a minimum number of pump strokes are performed by the high pressure fuel pump, where the minimum number of pump strokes is selected based on one or more of: a temperature of the internal combustion engine and a period of time since the internal combustion engine was previously shut-off, among other previously described operating conditions that may affect the estimated fuel rail pressure. In this way, the estimated fuel rail pressure may be used to advantage by the control system to reduce a duration of the cranking phase of the starting operation if the estimated fuel rail pressure indicates that the first value is likely to have been attained.

After the fuel pressure within the fuel rail approaches or attains the first value, the method includes initiating delivery of fuel to the internal combustion engine from the fuel rail by successively injecting fuel directly into combustion chambers of the internal combustion engine. After at least a first fuel injection event, the method includes reducing the fuel pressure within the fuel rail from the first value to a second value over subsequent successive fuel injection events by adjusting an operating parameter of the high pressure fuel pump. The operating parameter may include the pump stroke volume of the high pressure fuel pump, where adjusting the operating parameter of the high pressure fuel pump includes reducing a pump stroke volume of the high pressure fuel pump. For example, reducing the pump stroke volume of the high pressure fuel pump may include reducing the pump stroke volume to a minimum pump stroke volume of the high pressure fuel pump.

In some embodiments, the operation of reducing the fuel pressure within the fuel rail from the first value to the second value is performed responsive to degradation of a fuel rail pressure sensor. In response to a non-degraded state of the fuel rail pressure sensor, the method may include adjusting the fuel pressure within the fuel rail after at least the first fuel injection event to a third value that is greater than the second value responsive to a non-degraded state of the fuel rail pressure sensor.

It should be appreciated that the method may include operating a low pressure fuel pump to provide pressurized fuel to a low pressure regulation device that exceeds a pressure relief setting of the low pressure regulation device. In this way, the pressure relief setting of the high pressure regulation device corresponds to the first value and the where the pressure relief setting of the low pressure regulation device corresponds to the second value. In some embodiments, the control system may limit the performance of the internal combustion engine responsive to degradation of the fuel rail pressure sensor if the fuel pressure is reduced to the second value. For example, the control system may limit the speed, of the engine, the speed of the vehicle, or an engine load.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium (e.g., memory) of the control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of starting an internal combustion engine, comprising:

adjusting a fuel pressure within a fuel rail to a first value by operating a high pressure fuel pump to provide pressurized fuel to a high pressure regulation device that exceeds a pressure relief setting of the high pressure regulation device, the high pressure regulation device in fluid communication with the fuel rail;

after the fuel pressure within the fuel rail attains the first value, initiating delivery of fuel to the internal combustion engine from the fuel rail by successively injecting fuel directly into combustion chambers of the internal combustion engine; and reducing the fuel pressure within the fuel rail from the first value to a second value over subsequent successive fuel injection events after at least a first fuel injection event by adjusting an operating parameter of the high pressure fuel pump.

2. The method of claim 1, where operating the high pressure fuel pump to provide pressurized fuel to the high pressure regulation device that exceeds the pressure relief setting of the high pressure regulation device is performed if a state of a fuel rail pressure sensor is degraded; and where the method further comprises, adjusting an operating parameter of the high pressure fuel pump to provide pressurized fuel to the high pressure regulation device that does not exceed the pressure relief setting responsive to feedback from the fuel rail pressure sensor if the state of the fuel rail pressure sensor is non-degraded.

3. The method of claim 1, where the operating parameter includes a pump stroke volume of the high pressure fuel pump, and where adjusting the operating parameter of the high pressure fuel pump includes reducing a pump stroke volume of the high pressure fuel pump.

4. The method of claim 3, where reducing the pump stroke volume of the high pressure fuel pump includes reducing the pump stroke volume to a minimum pump stroke volume of the high pressure fuel pump.

5. The method of claim 1, where operating the high pressure fuel pump to provide pressurized fuel to the high pressure regulation device that exceeds the pressure relief setting of the high pressure regulation device includes setting a pump stroke volume of the high pressure fuel pump to a maximum pump stroke volume.

6. The method of claim 5, where setting the pump stroke volume of the high pressure fuel pump to the maximum pump stroke volume is performed responsive to a lower temperature state of the fuel rail; and where the method further comprises, setting the pump stroke volume of the high pressure fuel pump to a lesser pump stroke volume than the maximum pump stroke volume responsive to a higher temperature state of the fuel rail before the delivery of fuel to the internal combustion engine is initiated.

7. The method of claim 1, further comprising, operating a low pressure fuel pump to provide pressurized fuel to a low pressure regulation device that exceeds a pressure relief setting of the low pressure regulation device, the low pressure regulation device in fluid communication with a fuel passage that fluidly couples the low pressure fuel pump to the high pressure fuel pump.

8. The method of claim 7, where the pressure relief setting of the high pressure regulation device corresponds to the first value and the where the pressure relief setting of the low pressure regulation device corresponds to the second value.

9. The method of claim 1, further comprising:

varying a number of pump strokes performed by the high pressure pump before initiating the delivery of fuel to the internal combustion engine responsive to one or more of a temperature of the internal combustion engine and a period of time since the internal combustion engine has been previously shut-off.

10. The method of claim 1, further comprising, varying an amount of fuel that is directly injected into the combustion chambers over one or more of the subsequent successive fuel injection events after the delivery of fuel to the internal combustion engine is initiated to increase an air-fuel ratio of air and fuel charges formed in the combustion chambers relative to an air-fuel ratio of the first fuel injection event.

11. The method of claim 1, where reducing the fuel pressure within the fuel rail from the first value to the second value is performed responsive to degradation of a fuel rail pressure sensor; and where the method further comprises adjusting the fuel pressure within the fuel rail after at least the first fuel injection event to a third value that is greater than the second value responsive to a non-degraded state of the fuel rail pressure sensor.

12. The method of claim 11, further comprising limiting performance of the internal combustion engine responsive to degradation of the fuel rail pressure sensor if the fuel pressure is reduced to the second value.

13. An engine system, comprising:

an internal combustion engine including one or more combustion chambers, each of the one or more combustion chambers including a direct fuel injector;

a fuel rail configured to supply fuel to the direct fuel injector of each of the one or more combustion chambers;

a fuel rail pressure sensor configured to provide an indication of a fuel rail pressure;

a fuel tank configured to store fuel;

a fuel passage fluidly coupling the fuel tank to the fuel rail;

a low pressure fuel pump arranged along the fuel passage;

a high pressure fuel pump arranged along the fuel passage between the low pressure fuel pump and the fuel rail;

a high pressure regulation device fluidly coupled with the fuel passage between the high pressure fuel pump and the fuel rail;

a low pressure regulation device fluidly coupled with the fuel passage between the low pressure fuel pump and the fuel tank; and a control system configured to, before delivering fuel to the internal combustion engine at start-up, assess a state of the fuel rail pressure sensor, and if the fuel rail sensor is in a degraded state, the control system is further configured to:

adjust a fuel rail pressure to a first value by operating the low pressure fuel pump to provide pressurized fuel to the low pressure regulation device that exceeds a pressure relief setting of the low pressure regulation device and by operating the high pressure fuel pump to provide pressurized fuel to the high pressure regulation device that exceeds a pressure relief setting of the high pressure regulation device;

initiate delivery of fuel to the internal combustion engine from the fuel rail by successively injecting fuel directly into the one or more combustion chambers of the internal combustion engine via the one or more direct fuel injectors after the fuel rail pressure attains the first value;

after at least a first fuel injection event, reduce the fuel rail pressure from the first value to a second value over subsequent successive fuel injection events by adjusting an operating parameter of the high pressure fuel pump and by continuing to operate the low pressure fuel pump to provide pressurized fuel to the low pressure regulation device that exceeds a pressure relief setting of the low pressure regulation device.

14. The engine system of claim 13, where the control system is configured to adjust the operating parameter of the high pressure fuel pump by reducing a pump stroke volume of the high pressure fuel pump from a maximum pump stroke volume to a minimum pump stroke volume.

15. The engine system of claim 13, where the control system is further configured to increase an air-fuel ratio of air and fuel charges formed in the one or more combustion chambers over each fuel injection event of the subsequent successive fuel injection events relative to at least the first fuel injection event by varying an amount of fuel that is directly injected into the combustion chambers.

16. The engine system of claim 13, where the control system is configured to operate the high pressure fuel pump at a higher pump stroke volume responsive to a lower temperature state of the fuel rail to provide pressurized fuel to the high pressure regulation device that exceeds a pressure relief setting of the high pressure regulation device before the delivery of the fuel to the internal combustion engine is initiated; and where the control system is configured to operate the high pressure fuel pump at a lower pump stroke volume responsive to a higher temperature state of the fuel rail before the delivery of fuel to the internal combustion engine is initiated.

17. A method of starting an internal combustion engine, comprising:

adjusting a fuel pressure within a fuel rail to a first value by operating a high pressure fuel pump at a first pump stroke volume to provide pressurized fuel to a high pressure regulation device that exceeds a pressure relief setting of the high pressure regulation device, the high pressure regulation device in fluid communication with the fuel rail;

initiating delivery of fuel to the internal combustion engine from the fuel rail by successively injecting fuel directly into combustion chambers of the internal combustion engine; and after at least a first fuel injection event, reducing the fuel pressure within the fuel rail to a reduced value over one or more subsequent successive fuel injection events by operating the high pressure fuel pump at a second pump stroke volume that is less than first pump stroke volume while operating a low pressure fuel pump to provide pressurized fuel to a low pressure regulation device that exceeds a pressure relief setting of the low pressure regulation device, the low pressure regulation device in fluid communication with a fuel passage that fluidly couples the low pressure fuel pump to the high pressure fuel pump.

18. The method of claim 17, further comprising:

increasing an air-fuel ratio of air and fuel charges formed in the combustion chambers over the one or more subsequent successive fuel injection events relative to at least the first fuel injection event by varying an amount of fuel that is directly injected into the combustion chambers responsive to an amount of fuel that was previously delivered to the internal combustion engine from the fuel rail since the delivery of fuel was initiated.

19. The method of claim 17, further comprising, before initiating the delivery of fuel to the internal combustion engine:

adjusting an operating parameter of the high pressure fuel pump responsive to a temperature state of the fuel rail to vary a pressure at which fuel is supplied to the fuel rail via the high pressure fuel pump;

where the operating parameter of the high pressure fuel pump is adjusted to provide a greater pressure increase across the high pressure fuel pump responsive to a lower temperature state of the fuel rail; and where the operating parameter of the high pressure fuel pump is adjusted to provide a lower pressure increase across the high pressure fuel pump responsive to a higher temperature state of the fuel rail.

20. The method of claim 17, further comprising:

initiating the delivery of fuel to the internal combustion engine after a minimum number of pump strokes are performed by the high pressure fuel pump; and selecting the minimum number of pump strokes based on one or more of: a temperature of the internal combustion engine and a period of time since the internal combustion engine was previously shut-off.

* * * * *